US006952169B1

(12) United States Patent
Simtion

(10) Patent No.: US 6,952,169 B1
(45) Date of Patent: Oct. 4, 2005

(54) CORDLESS/WIRELESS AUTOMATIC DETECTION AND SUPPRESSION SYSTEM

(76) Inventor: Adrian Simtion, 22426 N. 78 Dr., Peoria, AZ (US) 85383

( * ) Notice: Subject to any disclaimer, the term of this patent is extended or adjusted under 35 U.S.C. 154(b) by 190 days.

(21) Appl. No.: 10/277,142

(22) Filed: Oct. 22, 2002

(51) Int. Cl.[7] ..... G08B 17/12
(52) U.S. Cl. ..... 340/577; 169/60
(58) Field of Search ..... 340/577, 578, 340/579, 627, 628, 539.26, 539.27, 430, 528, 426.29, 449, 532; 169/60, 19, 56, 61

(56) References Cited

U.S. PATENT DOCUMENTS

| | | | | | |
|---|---|---|---|---|---|
| 3,752,235 | A | * | 8/1973 | Witkowski | 169/61 |
| 3,866,687 | A | | 2/1975 | Banner | 169/61 |
| 4,609,048 | A | | 9/1986 | Yasaki et al. | 169/61 |
| 4,645,009 | A | | 2/1987 | Hawelka et al. | 169/15 |
| 4,818,970 | A | | 4/1989 | Natale et al. | 340/539 |
| 5,125,458 | A | | 6/1992 | Berman | 169/16 |
| 5,333,785 | A | | 8/1994 | Dodds et al. | 239/69 |
| 5,465,795 | A | | 11/1995 | Galbraith et al. | 169/11 |
| 5,607,020 | A | | 3/1997 | Gebhardt | 169/48 |
| 5,813,606 | A | | 9/1998 | Ziff | 239/67 |
| 6,029,751 | A | * | 2/2000 | Ford et al. | 169/60 |
| 6,044,913 | A | | 4/2000 | Stehling et al. | 169/65 |
| 6,104,301 | A | * | 8/2000 | Golden | 340/628 |
| 6,302,146 | B1 | | 10/2001 | McHugh | 137/601.16 |
| 6,685,104 | B1 | * | 2/2004 | Float et al. | 239/63 |

* cited by examiner

*Primary Examiner*—Jeffery Hofsass
*Assistant Examiner*—Jennifer Stone
(74) *Attorney, Agent, or Firm*—Adam K Sacharoff; Much Shelist

(57) ABSTRACT

A wireless automatic detection and suppression system for the detection and suppression of a hazard within an environment, the system includes a wireless automatic suppression apparatus, and at least one detector positioned about the environment to detect a hazard, each detector further includes a transceiver for transmitting a wireless signal to a receiver upon detecting a hazard. The receiver is in communication with the apparatus. The apparatus also includes a cylinder containing an extinguishing agent and a valve attached to the cylinder. The valve has at least one discharge port that may be opened such that the extinguishing agent flows through each discharge port and out a discharge nozzle positioned about the environment. A receiver is in communication with the valve such that upon receiving a wireless signal that a hazard exists in the environment the valve will automatically open and expel the extinguishing agent out of the discharge nozzle(s). The apparatus has a capability to be activated manually in case of an emergency, and the capability to shut off all the sources that can be a hazard re-generator. Once the extinguishing agent is expelled a visual/audio indicator will be activated to indicate the suppression.

31 Claims, 5 Drawing Sheets

M-M
a) HEAT DETECTOR
b) SMOKE DETECTOR
c) OPTICAL DETECTOR OR ANY TYPE
10
20
25
30
32
34
40
42
44
46
48
50
52
54
56
58
62

VIEW "R" - "R"

CORDLESS/WIRELESS AUTOMATIC DETECTION AND SUPPRESSION SYSTEM

FIELD OF THE INVENTION

The present invention relates to fire detection and suppression systems and more particularly to a novel cordless/wireless automatic detection and suppression system.

BACKGROUND OF THE INVENTION

The subject of this invention is to provide an automatic detection and suppression system which can carry out an extinguishing operation more efficiently from a detection and performance point of view, while at the same time trying to eliminate a lot of weaknesses, malfunctions and installation problems. This type of system is a more practical and cost effective method to protect the interior contents of enclosed spaces such as cabinets or critical hazardous places. This is accomplished by the simplicity of the system installation. This simplicity eliminates any extra cost for installation of wiring, connections, or nylon/plastic tubing detectors, which generally involves qualified/skilled people or contractors. The system installation is also not restricted by the wire connection length limitation, discharge tubing length or other circumstances that will affect the detection process—all well known in the art.

In the performance view, which refers more to the detection and suppression aspect of the cordless/wireless automatic system, it is more efficient by reacting promptly and quickly suppressing the source of the problem even in the very beginning stage. For instance in a fire suppression system in accordance with the present invention the system is capable of suppressing the problem when there is only smoke or heat present, prior to the development of a fire that may create damages in the protected area. Also suppression systems could be used such as to detect and prevent the exposure of a specific gas, such as a leak in a chemical pipe, gas pipe, or any dangerous volatile vapor. The system also generates a very short discharge time by using an appropriate valve, which in turn permits a rapid build up of the extinguishing agent concentration in the protected space, thus eliminating any doubt of problems or re-ignition after the pressurized cylinder has exhausted its content. The systems can be easily manifolded together by simultaneous activation from the same controller or detector. This manifolding procedure will eliminate a lot of work, trouble and the high cost for extra piping and wiring that some times are impossible but yet critical for the performance, especially for places under the jurisdiction. In case of a wire connection the signal can be damaged or lost because of the magnetic field, static, heat, length of wire and any other inconvenience.

In case of a more complex approach, the controller will have a code that allows personnel to arm or activate and disarm or deactivate the system any time there is a concern about special protection for the people working inside that environment. Also, extra sensors can be mounted on the door to protect against the possibility of an accidental suppression during this time, and an alarm that will be activated when a malfunction is taking place in the system.

The fire, smoke and other type of sensors that will be part of the system can be per customer request or application requirements. These sensors can be independently powered and have a battery unit inside or attached to it, and as an additional feature a visual and/or audible alarm to signal when the battery is low. The sensors or detectors can also be connected to a power plug to a back up battery. The present system will be very open to any demand and flexible to any changes to be included and adopted to any fire protection application where the preservation of goods and information is a concern and where the quality and accuracy of the system is an important issue.

SUMMARY OF THE INVENTION

The present invention gives a lot of stability and trust in the process of detection and suppression in case of a hazard being generated in the protected area. The most important thing in the act of hazard suppression is the detection process that will be performed by the smoke, heat, optical, carbon monoxide, infrared or other type of sensors, which will include a transmitter, either as part of the sensor or as an attachment to the sensor. After the hazard has been sensed, a signal will be sent to the valve directly or indirectly thru a controller, which will be strategically placed out of the protected area. The valve will possess a receiver, either as part of the valve or as an attachment to the valve, which will receive the signal that will activate the valve, such as by a solenoid or other type of mechanism, and as a result the valve will open. Once the valve is opened the pressurized extinguishing agent will flow thru the connection couplings into the discharge tubing, thus being released in the protected space through discharge nozzles. When the discharge process is taking place, an audible alarm and/or visual indicators will simultaneously emphasize the exhaustion process and which system has been discharged. At the same time, all sources of power, gas, fuel, heat or ventilation system that relates to the protected environment, which can be potential of a hazard regeneration and expansion, will be automatically shut off. Once the extinguishing concentration of agent has been built up in the protected space, the hazard will be suppressed and/or extinguished virtually instantaneously. After a short period of time personnel will be able to remove, for the time being, the existing goods. In case of emergency the system may also be manually actuated or activated by a cordless remote control that may be secured in a location that is available for specified or qualified personnel.

The present invention is a novel approach for an automatic suppression and detection system designed to protect both "micro" and "macro" environment areas by having a maximum accuracy/efficiency in hazard detection. This is accomplished by having the system sense the hazard in the smoke or heat stage before the hazard gets a chance to develop and/or stabilize. The rapid sensing capability will in turn produce a prompt reaction, which will discharge the system, suppress the hazard, and prevent any re-ignition or re-occurrence of the hazard. The system characteristics are the following; it is not expensive to assemble and/or manufacture, it is very user friendly, it is easy to install, it has a high discharge ratio which helps in building up a very fast extinguishing concentration, which results in the hazard being suppressed immediately. This rapid hazard suppression may prevent equipment replacement, inventory replenishment, and rising insurance premiums due to major losses caused by an undetected hazard.

The system is unique in that the components are linked via a Cordless/Wireless connection such as radio frequencies/signals, infrared signals, optical signals, electromagnetic signals, and any other type of wireless communication means. This type of extinguishing system is also secured from a power failure by using a back up battery. The system also stands out for its professional design and engineering approach, which results in a practical, flexible and durable construction. This combination will be the best application for the protection of important things and goods, which may need very close attention. Concurrently, the system can be incorporated or be attached to a security alarm system and will be flexible for any other types of valves that are related to the hazard extinguishing industry.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figures 1, 1A:
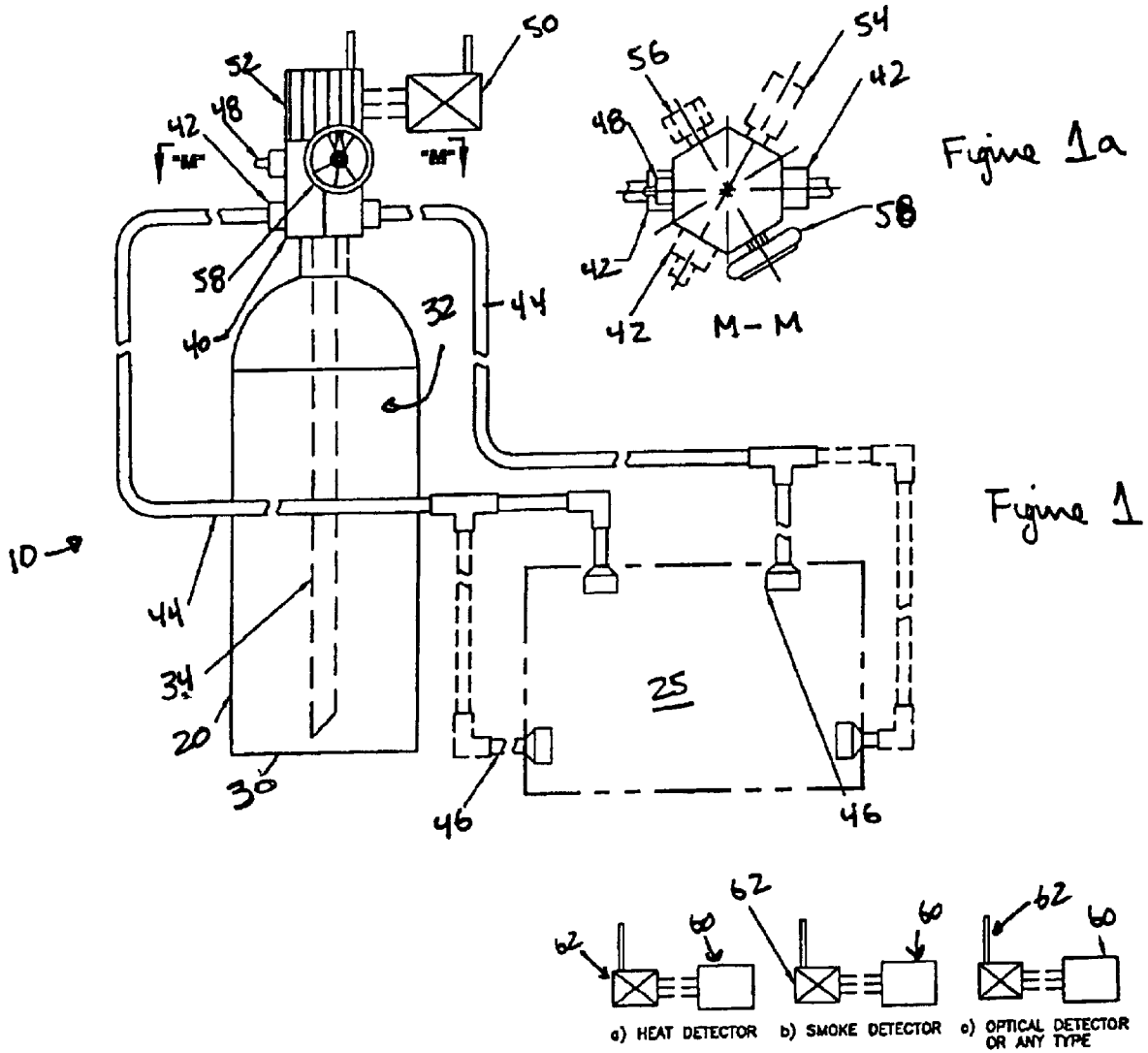
FIG. 1 is a system diagram of a cordless/wireless automatic detection and suppression system in accordance with the present invention.
FIG. 1*a* is a top view of section M—M from FIG. 1 which is one of many possible arrangements.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

The present invention finds applicability in both pre-engineered and engineered systems. According with the NFPA "National Fire Protection Association" standards the Pre-Engineer/Engineer systems are classified as follows.

Engineered Systems—those requiring individual calculation and design to determine the flow rates, nozzle pressure, pipe size, area or volume protected by each nozzle, quantities of extinguishing element, number and types of nozzle, and their placement in a specific system.

Pre-Engineered Systems—those having predetermined flow rates, nozzle pressure, and quantities of extinguishing element. These systems have the specific pipe size, maximum and minimum pipe lengths, numbers of fittings, and number and types of nozzles prescribed by a testing laboratory. The maximum and minimum pipe lengths and the number of fittings shall be permitted to be expressed in equivalent feet of pipe. The hazard protected by these systems are specifically limited as to type and size by a testing laboratory, based on actual fire tests. Limitation on hazards that are permitted to be protected by these systems and piping and nozzle configuration are contained in the manufacturer's listed installation and maintenance manual, which is part of the listing of any system.

The present invention can further be designed to be applicable for the following fire classes; Class A; Class B; Class C; Class D; and Class K, but not limited to this. This system can be Engineered and customized for a lot of applications and also Pre-Engineered to be listed with UL/FM according with the NFPA standards and abroad, because it falls in the standard requirements and performance for the following: (1) Dry-Chemical System NFPA 17/UL 1254; (2) Carbon Dioxide System NFPA 12/UL 2127; (3) Foam System NFPA 18/UL 162; (4) 3M's NOVAC 1280 Clean Agent System NFPA 2001/UL 2166; (5) HALOTRON Clean Agent System NFPA 2001/UL 2166; (6) F-500 Water Additive System NFPA 18/UL 162; and (7) other present and future extinguishing agents.

Referring now to FIG. 1 one system in accordance with the present invention is provided. The system generally referenced as 10 includes a cordless/wireless automatic suppression apparatus 20 and cordless/wireless automatic detection devices 60 designed to preserve the integrity of goods held within a protected area 25. Briefly, the cordless/wireless automatic suppression apparatus 20 includes a cylinder 30 that is filled with an extinguishing agent 32. The cylinder 30 is attached to a valve 40. The means for attachments are preferably a threaded connection, however other attachments means may be utilized. To transport the extinguisher agent 32 through the valve 40, a siphon tube 34 is employed to achieve a full discharge. In communication with the valve 40 is a single or are a plurality of discharge port connectors 42. Each discharge port connectors 42 connect a discharge tube 44 to one or more discharge nozzles 46. When activated, the extinguishing agent will flow through the siphon tube 34 and exit the discharge nozzles 46.

The cylinder 30 is pressurized prior to being attached to the system 10. A charge port 48 connected to the valve 40 may be used to pressurize the extinguishing agent 32 with an inert expellant gas, for instance Nitrogen, or to charge with other agents that can be in a gas or liquid form. The expellant gas will travel through the siphon tube 34, such that mixing between the extinguishing agent and the expellant gas will be more thorough because the expellant gas will be inserted in from the bottom, thus eliminating the possibility of the agent getting packed, often found in dry-chemicals such as powdered agents. Agent packing typically happens when the cylinder is pressurized from the top or in the absence of the siphon tube.

Once an automatic detection device 60 has detected a hazard, such as but not limited to a fire or smoke, a wireless signal will be sent through a transmitter 62 in communication with the automatic detection device. The signal may then be received by a controller that relays the signal to a valve receiver 50 (referred to herein as an indirect communication or signal relay) or the signal may directly be received by the valve receiver 50 (referred to herein as a direct communication or signal relay). The valve receiver 50 may be an external signal receiver or an internal signal receiver. The automatic detection devices 60 are placed throughout the protected area 25, and may consist of typical detection devices that detect such as but not limited to fire, flame, smoke, gas, combustible vapor, heat, optical, and any other abnormal conditions.

The valve receiver 50 is in communication with the valve 40 such that upon receiving an indirect or direct signal from one of the detection devices 60, the valve 40 will automatically open to allow the flow of extinguishing agent 32 through the discharge nozzles 46. This may be achieved by using a solenoid 52, or other type of actuator, to control the operation of the valve 40. The discharge nozzles 46 will disperse the extinguishing agent 32 swiftly and proportionally in the protected area 25, which will help build a balanced and harmonious concentration of agent in any part of the surrounded space being enclosed. After the concentration is built, the problem will be suppressed or extinguished quickly without damage to the protected space or its contents.

For safety and security, the system includes a pressure switch 54 or multiple pressure switches that are attached to the valve 40 that at least performs one or more of the following functions. The pressure switch 54 or multiple pressure switches activate an audio and/or visual indicator emphasizing that suppression has taken place; sense a pressure leak in the system 10 and will activate an audio and/or visual indicator that shows a malfunction in the system 10 and the necessity to repair and/or replace the fault to avoid future problems; and/or turn off various power sources, gas, fuel, heat or ventilation systems that may be a potential of regeneration and expansion of the hazard. As explained in greater detail some of these functions may be preformed by a controller that is in communication with the system.

A pressure gauge 58 is also attached to the system 10 and indicates the pressure of the extinguishing agent. The specific type of pressure gauge 58 will depend upon the type of agent and operating pressure used in the system 10. Moreover, when it is a requirement for the system 10, the system will also be provided with a safety pressure relief device 56 for protection in case of a pressure increase above admissible limits. In some instances the safety pressure relief device 56 will be in accordance to domestic, local or foreign standards or regulations. The arrangement in (FIG. 1*a*) is a top view thru section M—M and represents a single example and is not meant to represent a standard arrangement.

The present invention will now be discussed in more detail to various uses of the present invention in different environments. It is however noted that the environments discussed herein are exemplary in nature and do not intend to limit the scope of spirit of the invention.

Figure 2A:
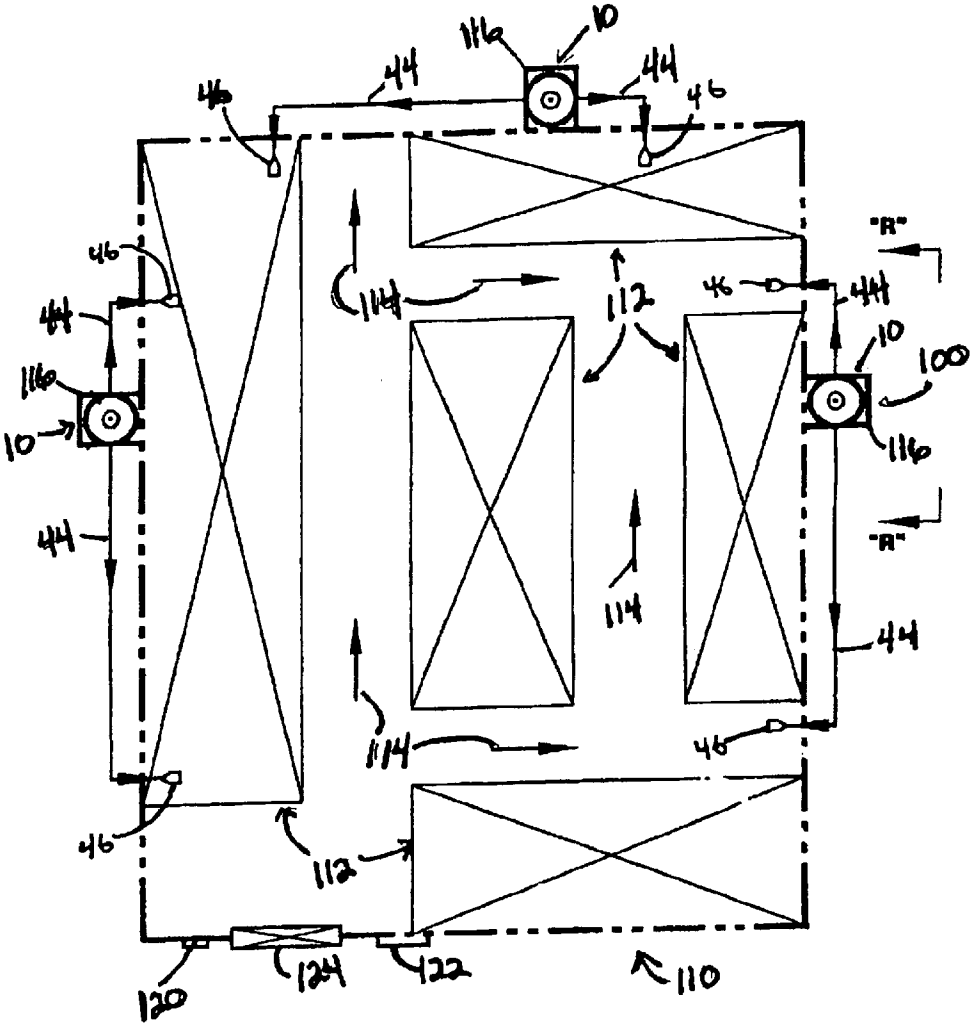
FIG. 2*a* is a system diagram of a cordless/wireless automatic detection and suppression system for a macro environment.
Figure 2B:
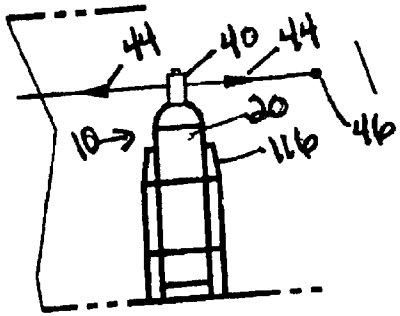
FIG. 2*b* is a section R—R view of the suppression systems from FIG. 2*a;*

Referring to FIG. 2*a* there is shown an automatic detection and suppression system 100 in accordance with the present invention employed in a storage room 110 or other macro environment. The storage room 110 includes a plurality of shelves 112 spaced about the room 110 as well as a plurality of open areas 114 that permit a person to walk around the room 110. To ensure against the destruction of any items stored in the room 110 the macro suppression system 100 employs more than one suppression system 10. Each suppression system 10 may be either mounted on the floor (FIG. 2*b*) or the wall with a bracket 116 outside or inside of the protected space.

To ensure a good detection, the detectors (not shown) will be mounted in strategic places on the walls ceiling or other critical locations. Upon detection, a wireless signal will be sent to the receivers 50 on each system 10 such that the valves 40 will open. Thereby releasing the extinguishing agent through the discharge tubes 44, out the discharge nozzles 46 into the protected areas. Because of the multiple systems 10 employed the concentration of the agent will build up vary fast inside the macro environment and in the total flooding process will stop the hazard very rapidly preserving the items contained in the environment.

In the same environment it may be beneficial to have an indirect signal communication between the detectors 60 and the receivers 50. In such a system, when a detector 60 transmits a signal, the signal is initially received by a cordless controller 120, which is located on a wall inside or outside the macro environment 110. The controller 120 further relays the signal to the wireless valve receivers 50. The controller 120 may then provide an audio and/or visual indication that the macro automatic detection and suppression system 100 has been activated. As mentioned above, each suppression system 10 may also include an audio/visual display, which may indicate whether there is a malfunction or a discharge to a specific suppression system 10. In addition, the controller 120 will preferably be in communication with and have the ability to turn off any or all of the power sources, gas, fuel, heat or ventilation systems that relate to the macro environment 110, which can be a potential portal for the regeneration or expansion of the hazard. Moreover, the audio/visual indication will also notify a user or other personal that the automatic detection and suppression system 100 has been activated, so any additional appropriate action may be taken.

The controller 120 can also receive signals from the pressure switches on each suppression system 10, such that if a pressure drop is sensed in a cylinder because of a pressure leak, the malfunction will be indicated on the controller 120. In other embodiments, the controller 120 may be connected into the phone system or alarm system such that security personnel, the fire department or other emergency teams are properly notified. In the case of absence of a controller 120, the pressure switch/switches will cover the three functions and mentioned above: to provide an audio and/or visual indication in case of a suppression, to indicate a malfunction in the system and to shut off any of the power sources or those that can be a potential for regeneration or expansion of the hazard.

Any entrances 124 to the macro environment 110 could further be connected to the controller 120. In such instances, if a person opened the entrance 124, and because the suppression system has a potentially harmful agent, the suppression systems 10 could be automatically disarmed. Alternatively, if a person opened the entrance 124, the opening of the entrance 124 will disarm the system until the person left and closed the entrance 124, and put a re-arm pin number in the outside controller 120. For more safety purposes the pin number will be entered only by an authorized personnel that will check the environment to determined whether anybody else is inside the protected space. This prevents the release of a potential extinguishing agent while a person is in the room. In another embodiment the controller 120 could automatically seal any entrances 124 to the macro environment 110 when the suppression systems 10 are distinguishing the extinguishing agents, thereby protecting any person from harmful agents. In a direct sensor-valve or indirect sensor-controller-valve application, a cordless remote control unit 122 may be used outside the macro environment 110 that can manually activate or deactivate the valves on the suppression system 10 in case of an emergency. In yet other embodiments, if an unauthorized person enters the environment, the controller 120 could signal an audio/visual alarm (of the presence of an unauthorized person), which must be turned off by an authorized person. In such events, the suppression system will disarm themselves until the authorized person resets the suppression system, either manually or remotely. It should be further noted that while the suppression system will be disarmed and re-armed, the detectors are still activated. Thus in the event that the suppression system was disarmed and a hazard became present in the environment, the detectors would still send a signal to the controller. The controller could then send an appropriate alarm as well as indicate the presence of a hazard. The suppression system could then still be re-armed from outside the environment and the controller would then send a signal to the receivers in communication with the valves, to open.

Figure 3:
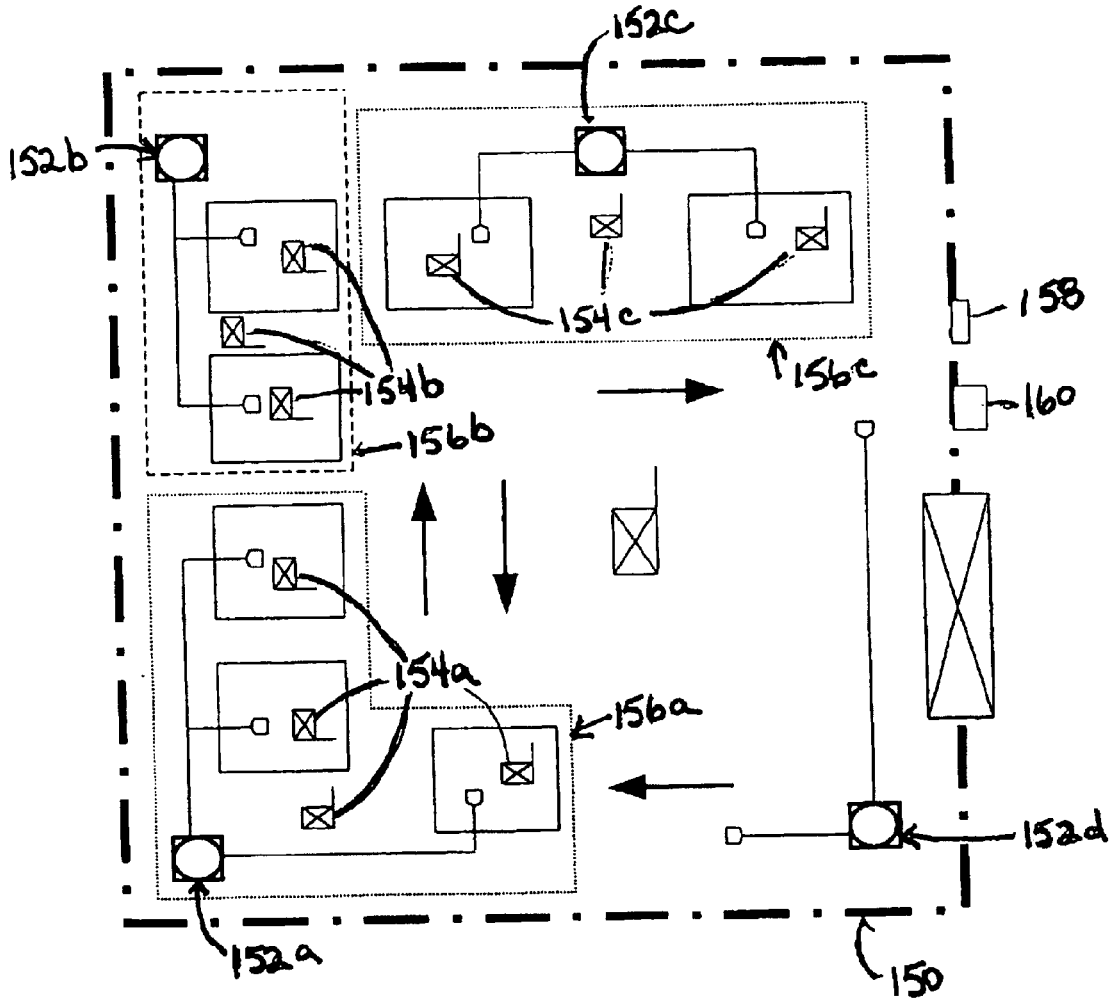
FIG. 3 is a system diagram of a cordless/wireless automatic detection and suppression system for a macro environment containing several micro environments.

In addition, the detectors 60 may be individually attuned to a specific suppression system 10, such that if a specific detector 60 detects a problem, the specific suppression system 10 will only be activated, as opposed to activating all of the systems 10. For example, FIG. 3 illustrates a macro environment 150 such as a computer server room. The environment 150 includes a plurality of suppression systems, illustrated as four sequential suppression systems 152*a,* 152*b,* 152*c,* 152*d;* each similarly configured to the automatic suppression system described above. Each suppression system includes a set of detectors 154*a,* 154*b,* 154*c,* and 154*d.* Moreover, each system is desired to protect a micro environment inside the macro environment. As such the first automatic detection and suppression system 152*a*/154*a* is designed to protect the micro environment or servers within the generally area 156*a.* Similarly, the second automatic detection and suppression system 152*b*/154*b* is designed to protect area 156*b* and the third automatic detection and suppression system 152*c*/154*c* is designed to protect area 156*c.* The fourth automatic detection and suppression 152*d*/154*d* is designed to protect the macro environment 150.

When a detector detects a problem in one of the areas it sends a signal directly to its corresponding suppression system or indirectly through the main controller 158, which may be located inside or outside of the macro environment 150. The corresponding suppression system having received the signal from one of its corresponding detectors can protect the corresponding area by releasing its extinguishing agent. Since only the corresponding suppression system has released its extinguishing agent, the other areas will not be covered with the agent. This may be extremely beneficial, especially when each area includes delicate items that need to be protected in a special way. As such the present embodiment provides a system that will protect area separately and apart from the other adjoining areas.

As mentioned above, the detectors can send the signal directly to the corresponding system or indirectly thru a controller 158. The controller 158 could then send or relay the signal to the corresponding system. In addition, the controller 158 further includes an automatic override signal that can be transmitted to each automatic suppression system such that all of the systems 152 will be activated. This may become useful if under certain circumstances the macro environment needs protection even if the detection is localized in a specific area, for example if detector 154*c* detects smoke in area 156*c,* the corresponding automatic suppression system 152*c* may activate to prevent the smoke from become a fire or spreading into the other areas. However, if a fire is detected in the same area 156*c,* all of the automatic suppression systems 152*a,* 152*b,* 152*c* and 152*d* may be activated in order to make sure the fire does not spread and is totally extinguished. As in the other embodiments this application stands out also for the capability of the system to be manually activated in case of an emergency by a cordless controller 160. The controller 158 can notify via alarm/phone if the suppression took place or in case of a malfunction. For more safety the system can be disarmed/armed when a person is inside to avoid an accident. The pressure switch can also have the same attributes as in the prior embodiments.

Figure 4A:
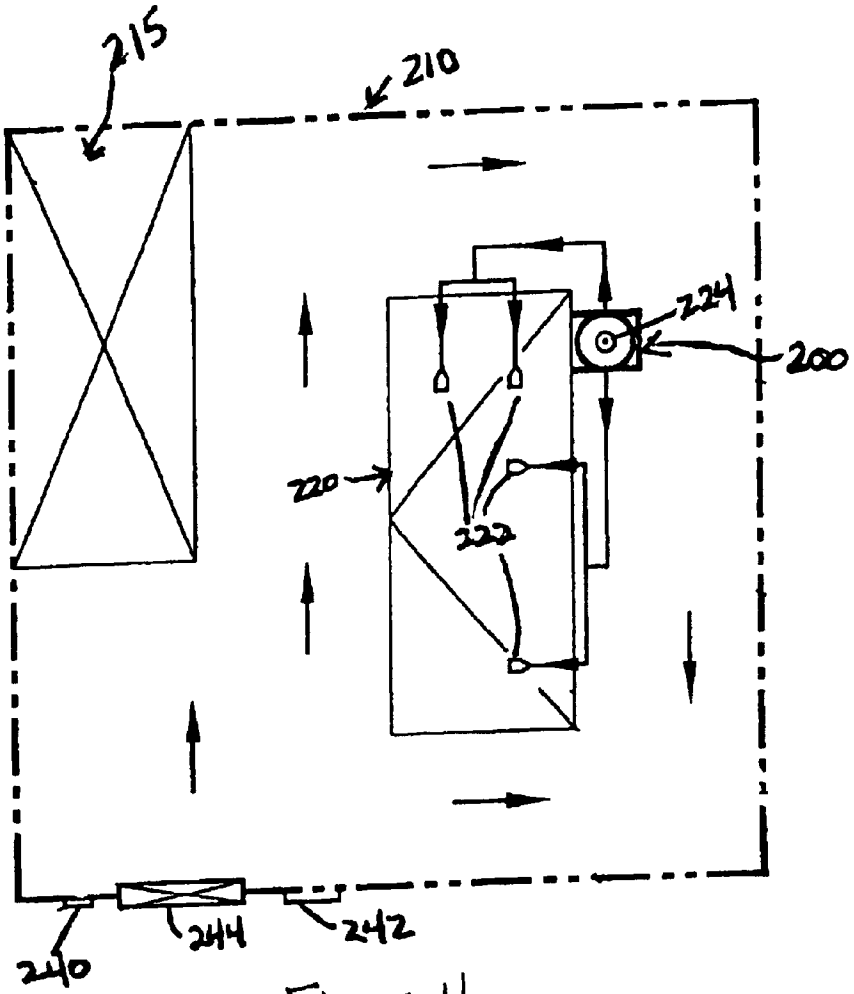
FIG. 4*a* is a system diagram of a cordless/wireless automatic detection and suppression system for a compartment environment in accordance with another embodiment of the present invention.
Figure 4B:
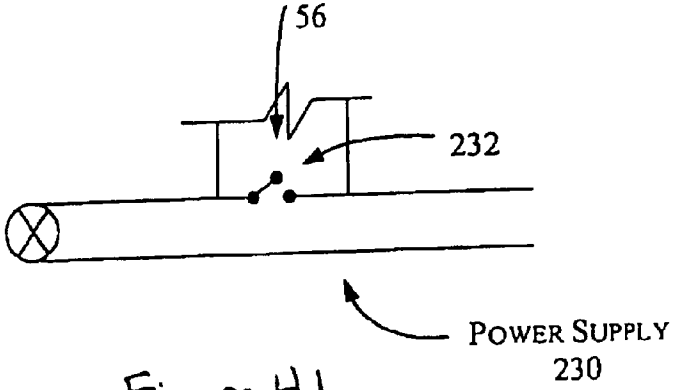
FIG. 4*b* is a system diagram of the pressure switch device in communication with a power supply such that when the pressure decreases inside the cylinder because of a suppression of the cordless/wireless automatic detection and suppression system the power will be cut off and a visual and/or audio alarm will be activated.

Referring to FIGS. 4*a* and 4*b* there is shown an automatic detection and suppression system 200 in accordance with the present invention employed in an engine room environment 210, such as but not limited to a boat or yacht engine. The engine room 210 may have various cabinets 215 as well as a separate engine compartment 220. To protect the engine room from a fire or other hazard, the automatic detection and suppression system 200 is attached to the engine compartment 220 with various detectors and discharge nozzles 222 placed within the engine compartment 220. The detectors may be strategically mounted around the engine or inside the compartment in critical locations.

Upon detection of a hazard, the signal will be sent directly to the wireless valve receiver 224 that will control the discharge of the extinguishing agent through the discharge nozzles 222. As a result of the concentration build up in the compartment 220 the hazard will be extinguished preserving all of the area outside and inside of the compartment. In this case the pressure switch/switches will perform at least the three functions to prevent a malfunction, shut the power sources and to indicate the suppression.

After detection by the automatic wireless detection devices 222, the signal can be sent indirectly to the wireless valve receivers 224 thru the controller 240. In this instance the controller 240 can perform the at least three functions, mentioned above.

Illustrated in FIG. 4*b,* the pressure switch device 56 is integrated into a power supply 230 of the engine compartment 220. When the pressure inside the cylinder of the automatic detection and suppression system 200 decreases, meaning the extinguishing agent is being dispensed, the pressure switch device 56 will open a switch 232, cutting power to the power supply 230. Similar systems are readily apparent for cutting off the power to the fuel system, heating system, ventilation systems, etc. In addition other means or device may be employed to monitor a suppression and automatically shut the power off.

Moreover, the automatic detection and suppression system 200 in the direct/indirect embodiments can further automatically notify the personnel on the ship as well as the Coast Guard that a hazard suppression has taken place on a certain boat. Moreover, if the suppression system 200 is attached to a GPS system, the location of the boat could further be relayed to the Coast Guard. The automatic detection and suppression system 200 may further be provided with a cordless remote controller 242 outside the environment 210 that is able to manually activate the suppression system in case of an emergency. In addition, the door 244 to the environment 210 may include means that temporarily disarms the suppression system 200 when a person opens the door 244 and activate an audio/visual alarm during the presence of the person inside until the person gets out, closes the door and re-arms the system with a safety pin number. For additional safety authorized personnel will enter the pin in the controller. Yet for additional safety, the system controller 240 may also require a pin number to unlock the door and allow a person to get in the environment and at the same time will disarm the system while the person is inside the environment.

Figure 5A:
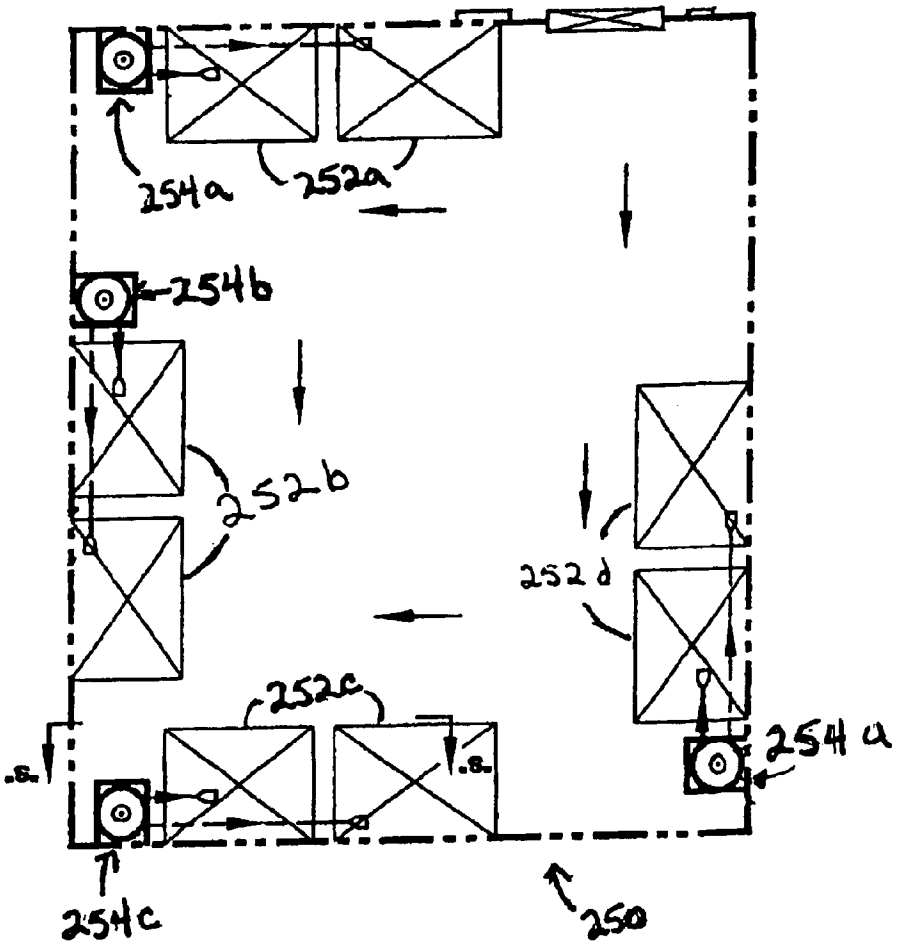
FIG. 5*a* is a system diagram of a cordless/wireless automatic detection and suppression system for a office, storage or room environment in accordance with another embodiment of the present invention.
Figure 5B:
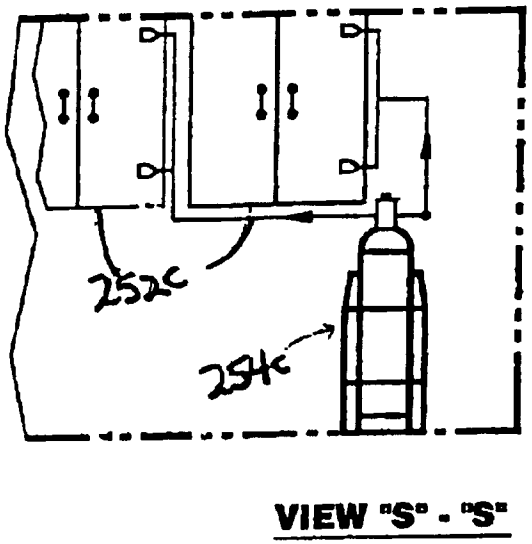
FIG. 5*b* is a section S—S view from FIG. 5*a* for in particularly cabinets protection.

Referring to FIGS. 5*a* and 5*b* there is shown an automatic detection and suppression system in accordance with the present invention employed for use in file cabinets in order to protect the items located inside the cabinets from a hazard. The macro environment, typically an office 250, includes a plurality of cabinets 252 that are protected with a plurality of automatic detection and suppression systems 254. Detectors are mounted within the cabinets 252. As discussed previously, upon detection of a hazard all of the automatic detection and suppression systems can release their extinguishing agent or the automatic detection and suppression systems can separately release the agent in accordance of where the hazard was detected.

Other embodiments include automatic detection and suppression system for a car engine. The automatic detection and suppression system would be mounted to the chassis of the car under the hood with discharge nozzles positioned about the engine block of the car. The detectors would also be strategically located around the engine of the car. Upon the detection of a hazard, such as a fire, the automatic detection and suppression system would extinguish the hazard contained therein and shut off critical areas of the car, such as the fuel flow to the engine, this would help suppress and prevent the fire from spreading or regenerating.

Yet another embodiments include a warehouse environment. The warehouse includes a plurality of machines, each having a separate power and fuel supply. Each machine further includes a wireless automatic suppression apparatus and corresponding detectors positioned about one of the machines. Upon detecting a hazard on a machine the wireless automatic suppression apparatuses positioned about the machine suppresses the hazard and the pressure switch device on the wireless automatic suppression apparatus shuts the power and fuel supply of the machine and notify the place with the problem through an audio/visual alarm. This permits the overall protection of the area without having a complete flood of the area with the extinguishing agent. This also allows the protection of the area with the most minimum amount of damage or disruption. As such, if a hazard erupts about a single machine, the rest of the machines are still operational, allow operations to continue. In addition, a manual actuator such as a cordless remote control may be provided, as mentioned in the other embodiments.

The design of this system will be an appropriate application for the residential, commercial, industrial, and military and outer-space fields. Potential applications may consist of the following; office cabinets, computer rooms, machines, cooking ducts and hoods, boats and yachts, bank vaults, engine rooms, aviation, space shuttles and other space based vehicles, military, laboratory, library, storage rooms, electrical enclosures, or any enclosure that surrounds or protects various types of goods or things that can be a potential fire source. This includes the storage of hazardous and important material. For example on a plane or spaceship the environment can be flooding with Oxygen in a case of an emergency due to oxygen depletion. These applications can have a pre-engineered, or engineered system, depending on customer requirements. The system is suitable/appropriate for our new era technology and is easy to be adapted or included with existing systems, by usage of simple through very complex controllers and primary logic controllers (PLC).

The system is very easy and flexible for usage with many types of extinguishing agents like carbon dioxide, foam, clean agents, water additive, dry-chemical and any other present or future extinguishing agents. It can be applied or adapted to a lot of applications, especially for "Total Flooding Protection", "Local Application Protection", "Restaurant Cooking Area Protection", "Vehicle Protection System", "Maritime Coast Guard Applications", or any time there is a request for automatic fire detection and suppression.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A wireless automatic detection and suppression system for the detection and suppression of a hazard within an environment, the system comprising:

a wireless automatic suppression apparatus, the apparatus includes:

a cylinder containing an extinguishing agent, a valve attached to the cylinder, the valve has at least one discharge port that when opened, the extinguishing agent flows through said one discharge port, each discharge port having a discharge tubing and at least one discharge nozzle positioned about the environment, and a receiver in communication with the valve such that upon receiving a wireless signal that a hazard exists in the environment the valve opens the at least one discharge port to expel the extinguishing agent out of said at least one discharge nozzle;

at least one detector positioned about the environment to detect a hazard, each detector further includes a transceiver for transmitting a wireless signal to the receiver upon detecting a hazard; and an entrance sensor in communication with the receiver in communication with the valve, the entrance sensor sends an open entrance signal or a closed entrance signal to the receiver such that when the receiver receives said open entrance signal, said suppression apparatus disarms and when the receiver receives said closed entrance signal, said suppression apparatus is capable of being armed.

2. The system of claim 1 further comprising:

a controller positioned outside of the environment, the controller having a receiver for receiving the wireless signal from the detectors, when the detectors detect a hazard within the environment.

3. The system of claim 2 wherein the transceiver, of each detector, transmits said wireless signal to the receiver of the controller and said controller includes a control transceiver to relay the signal to the receiver in communication with the valve.

4. The system of claim 3 wherein said entrance sensor is in wireless communication with the controller, such that the entrance sensor sends said open entrance signal or said closed entrance signal to the controller such that when the controller receives said open entrance signal, said controller disarms the suppression apparatus and when the controller receives said closed entrance signal, said controller is capable of being rearmed by entering a pin number into the controller.

5. The system of claim 4 further comprising at least two wireless automatic suppression apparatuses and corresponding detectors are wirelessly linked together within the environment, such that when a detector detects a hazard and sends a wireless signal to a corresponding wireless automatic suppression apparatus, said corresponding wireless automatic suppression apparatus will expel the extinguishing agent contained therein while a non-corresponding wireless automatic suppression apparatus retains extinguishing agent contained therein until the reception of a wireless signal from a detector corresponding to said non-corresponding wireless automatic suppression apparatus.

6. The system of claim 1, wherein the wireless automatic suppression apparatus includes an audio and/or visual indicator to indicate the reception of a wireless signal and to indicate the expulsion of extinguishing agent.

7. The system of claim 1 wherein the apparatus includes a siphon tube and a charge port to pressurize the cylinder such that substantially all of the extinguishing agent is discharge at a constant pressure.

8. The system of claim 1, wherein the wireless automatic suppression apparatus includes a charge port for pressurizing or charging the extinguishing agent with but not limited to an inert expellant gas.

9. The system of claim 1 further comprising a pressure relief device to vent excess pressure in the cylinder if a pressure in the cylinder exceeds a predetermined pressure set in the pressure relief device.

10. The system of claim 1, wherein the wireless automatic suppression apparatus includes a manual activation.

11. The system of claim 1, wherein the wireless automatic suppression apparatus includes a pressure gauge to indicate a current pressure of the extinguishing agent contained within the cylinder.

12. The system of claim 11, further comprising a means in communication with a power source, fuel source, gas source, heat source and/or ventilation system such that when the extinguishing agent is being expelled, said means disconnects the power source, fuel source, gas source, heat source and/or ventilation system.

13. The system of claim 12, wherein the environment is a car and said wireless automatic suppression apparatus, discharge nozzles and detectors are positioned about an engine of said car, wherein upon detecting a hazard, a fuel supply line, defined by said car is automatically deactivated.

14. The system of claim 11, further comprising a means for determining when the current pressure of the extinguishing agent contained within the cylinder decreases because of a leak, such that when a leak occurs, said means indicates a malfunction with the apparatus.

15. A wireless automatic detection and suppression system for the detection and suppression of a hazard within an environment, the system comprising:

at least two wireless automatic suppression apparatuses, each apparatus includes:

a cylinder containing an extinguishing agent, a valve attached to the cylinder, the valve has at least one discharge port such that when the valve is opened, the extinguishing agent flows through said one discharge port, each discharge port having a discharge tubing and at least one discharge nozzle positioned about the environment, and a receiver in communication with the valve such that upon receiving a wireless signal that a hazard exists in the environment the valve opens to expel the extinguishing agent out of said at least one discharge nozzle;

at least one corresponding detector positioned about the environment to detect a hazard, each corresponding detector further includes a transceiver for transmitting a wireless signal to the receiver upon detecting a hazard; and an entrance sensor in communication with the receivers in communication with the valves, the entrance sensor sends an open entrance signal or a closed entrance signal to the receivers such that when the receivers receive said open entrance signal, said suppression apparatuses disarms and when the receivers receive said closed entrance signal, said suppression apparatuses are capable of being rearmed.

16. The system of claim 15, wherein each wireless automatic suppression apparatus includes an audio and/or visual indicator to indicate the expulsion of extinguishing agent by a respective apparatus.

17. The system of claim 15, wherein each wireless automatic suppression apparatus includes a manual activation.

18. The system of claim 15, wherein each wireless automatic suppression apparatus includes a siphon tube and a charge port for pressurizing or charging the extinguishing agent with but not limited to an inert expellant gas.

19. The system of claim 15, wherein each wireless automatic suppression apparatus includes a pressure gauge to determine a pressure of the extinguishing agent.

20. The system of claim 15 further comprising a pressure relief device in each automatic suppression apparatus to vent excess pressure in the cylinders if a pressure in said cylinders exceeds a predetermined pressure set in said pressure relief device.

21. The system of claim 15, wherein the at least two wireless automatic suppression apparatuses and corresponding detectors are wirelessly linked together within the environment, such that when a corresponding detector detects a hazard and sends a wireless signal to a corresponding wireless automatic suppression apparatus, said corresponding wireless automatic suppression apparatus will expel the extinguishing agent contained therein while a non-corresponding wireless automatic suppression apparatus retains extinguishing agent contained therein until the reception of a wireless signal from a detector corresponding to said non-corresponding wireless automatic suppression apparatus.

22. The system of claim 21 further includes a controller in wireless communication with the at least two wireless automatic suppression apparatuses, each detector upon detecting a hazard sends a hazard signal to the controller and the controller further relays said hazard signal to the corresponding wireless automatic suppression apparatus.

23. The system of claim 22, wherein when the hazard signal is a predetermined type the controller sends an activation signal to each wireless automatic suppression apparatus whereupon each wireless automatic suppression apparatus that receives said activation signal automatically activates to release the extinguishing agents contained therein.

24. The system of claim 21, wherein each wireless automatic suppression apparatus includes a means for determining whether the pressure of the extinguishing agent inside the cylinder decreases because of a leak, and wherein said means upon detecting a leak, indicates a malfunction is occurring.

25. The system of claim 21, wherein when the hazard is a predetermined type and a detector detects said predetermined type of hazard, said detector sends an activation signal to each wireless automatic suppression apparatus whereupon each wireless automatic suppression apparatus that receives said activation signal automatically activates to release the extinguishing agents contained thereon.

26. The system of claim 21, wherein each wireless automatic suppression apparatus includes a indicating means for the indication of a malfunction with the apparatus.

27. The system of claim 21, wherein each wireless automatic suppression apparatus includes a means that is in communication with a power source, fuel source, gas source, heat source or ventilation system such that when the extinguishing agent is being expelled, the means disconnects the power source, fuel source, gas source, heat source or ventilation system.

28. The system of claim 27, wherein the environment is a warehouse having a plurality of machines each having a separate power and fuel supply, and wherein each machines includes a wireless automatic suppression apparatus and corresponding detectors positioned about one of the machines, of said plurality of machines, such that upon detecting a hazard on a machine, of said plurality of machines, a wireless automatic suppression apparatus positioned about said machine suppresses said hazard and the means on said wireless automatic suppression apparatus shuts the power and fuel supply of said machine.

29. The system of claim 27, wherein the environment is a macro environment that is divisible into a plurality of micro environments and wherein each wireless automatic suppression apparatus and corresponding detector, of said at least one detector, are designated to a single micro environment, of said plurality of micro environments, such that when one of the detectors, detects a hazard in a micro environment, the wireless automatic suppression apparatus designated to said micro environment activates to extinguish the hazard.

30. The system of claim 27, wherein the environment is an engine and the means disconnects the fuel source to the engine.

31. The system of claim 27, wherein the environment is an office space and each wireless automatic suppression apparatus includes nozzles that are positioned inside a corresponding cabinet and the corresponding detectors are positioned inside said corresponding cabinet, such that upon detecting a hazard inside a corresponding cabinet, the wireless automatic suppression apparatus corresponding to said corresponding cabinet extinguishes the hazard.

* * * * *